US010158181B2

(12) United States Patent
Kim et al.

(10) Patent No.: US 10,158,181 B2
(45) Date of Patent: Dec. 18, 2018

(54) ANTENNA DEVICE FOR RADAR SYSTEM

(71) Applicant: LG INNOTEK CO., LTD., Seoul (KR)

(72) Inventors: Jong Guk Kim, Seoul (KR); Ja Kwon Ku, Seoul (KR); Sung Ju Kim, Seoul (KR); Hyoung Ki Nam, Seoul (KR); Hong Gil Yoo, Seoul (KR); Jeong Hoon Cho, Seoul (KR); Dong Hun Shin, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 170 days.

(21) Appl. No.: 14/913,551

(22) PCT Filed: Aug. 21, 2014

(86) PCT No.: PCT/KR2014/007798
§ 371 (c)(1),
(2) Date: Feb. 22, 2016

(87) PCT Pub. No.: WO2015/026187
PCT Pub. Date: Feb. 26, 2015

(65) Prior Publication Data

US 2016/0233589 A1 Aug. 11, 2016

(30) Foreign Application Priority Data

Aug. 21, 2013 (KR) ..... 10-2013-0099301

(51) Int. Cl.
*H01Q 1/32* (2006.01)
*H01Q 21/06* (2006.01)

(52) U.S. Cl.
CPC ..... *H01Q 21/065* (2013.01); *H01Q 1/3233* (2013.01)

(58) Field of Classification Search
CPC ..... H01Q 21/0006; H01Q 21/0075; H01Q 21/06; H01Q 21/065; H01Q 21/08;
(Continued)

(56) References Cited

U.S. PATENT DOCUMENTS 4,899,163 A * 2/1990 Daniel ..... G01S 13/60 343/700 MS
9,276,327 B2 * 3/2016 Binzer ..... G01S 7/03
(Continued)

FOREIGN PATENT DOCUMENTS

KR 20020046238 A 6/2002
KR 20110060716 A 6/2011
(Continued)

OTHER PUBLICATIONS

International Search Report in International Application No. PCT/KR2014/007798, filed Aug. 21, 2014.

*Primary Examiner* — Tho G Phan
*Assistant Examiner* — Patrick Holecek
(74) *Attorney, Agent, or Firm* — Saliwanchik, Lloyd & Eisenschenk

(57) ABSTRACT

The present invention relates to an antenna device for a radar system, comprising: a power supply unit; and a plurality of radiators disposed to be spaced from the power supply unit, wherein each radiator is formed according to a variable determined by a weight predetermined for each radiator. According to the present invention, the performance of the radar system can be improved by obtaining uniform performance of each radiator by forming each radiator according to the weight for each radiator.

5 Claims, 7 Drawing Sheets

(58) Field of Classification Search
CPC ..... H01Q 21/10; H01Q 1/32; H01Q 1/3208; H01Q 1/3233
See application file for complete search history.

(56) References Cited

U.S. PATENT DOCUMENTS

| | | | | |
|---|---|---|---|---|
| 2007/0279303 | A1* | 12/2007 | Schoebel ..... | H01Q 21/0075 343/713 |
| 2011/0128201 | A1 | 6/2011 | Ju et al. | |
| 2012/0229366 | A1 | 9/2012 | Ding | |
| 2015/0054712 | A1 | 2/2015 | Milyakh et al. | |

FOREIGN PATENT DOCUMENTS

| | | | |
|---|---|---|---|
| KR | 20130091993 | A | 8/2013 |
| KR | 101389837 | B1 | 4/2014 |

* cited by examiner

【Figure 1】
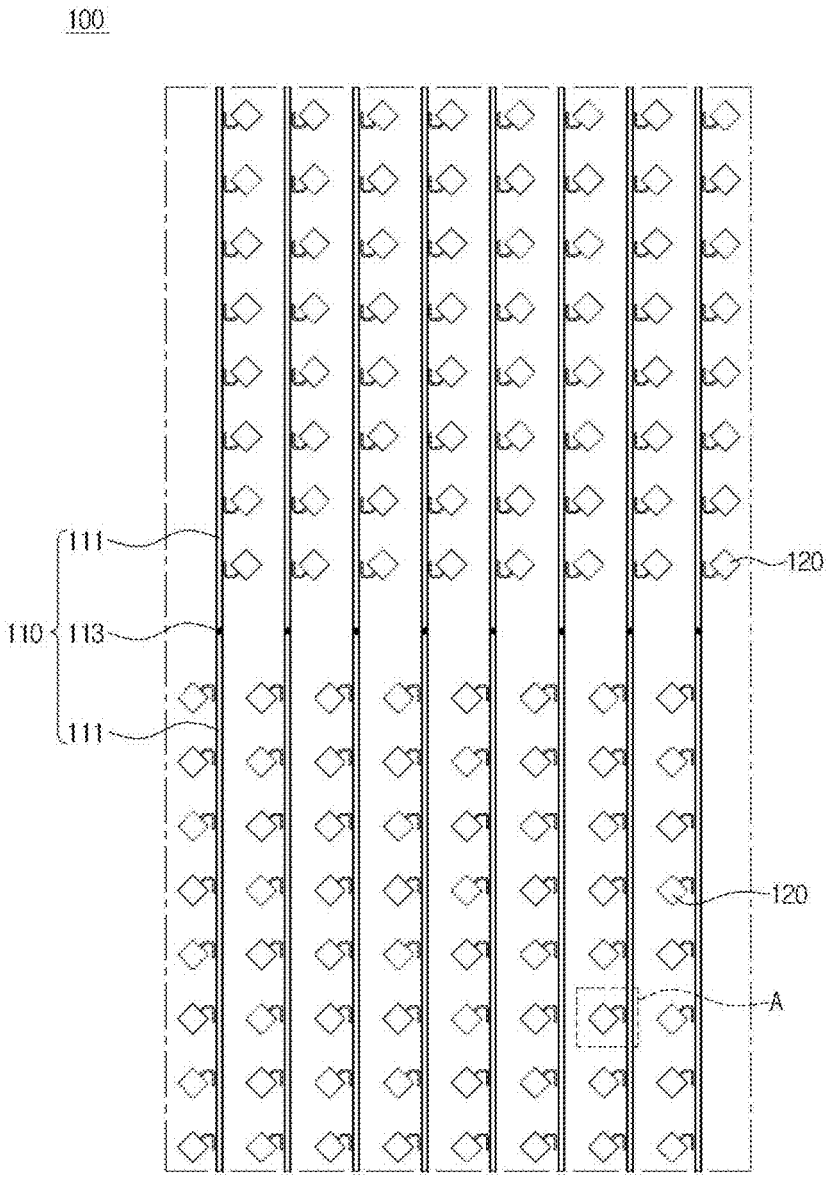

【Figure 2】
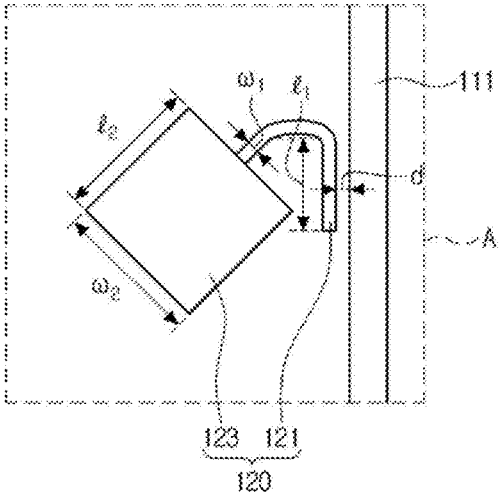

【Figure 3】
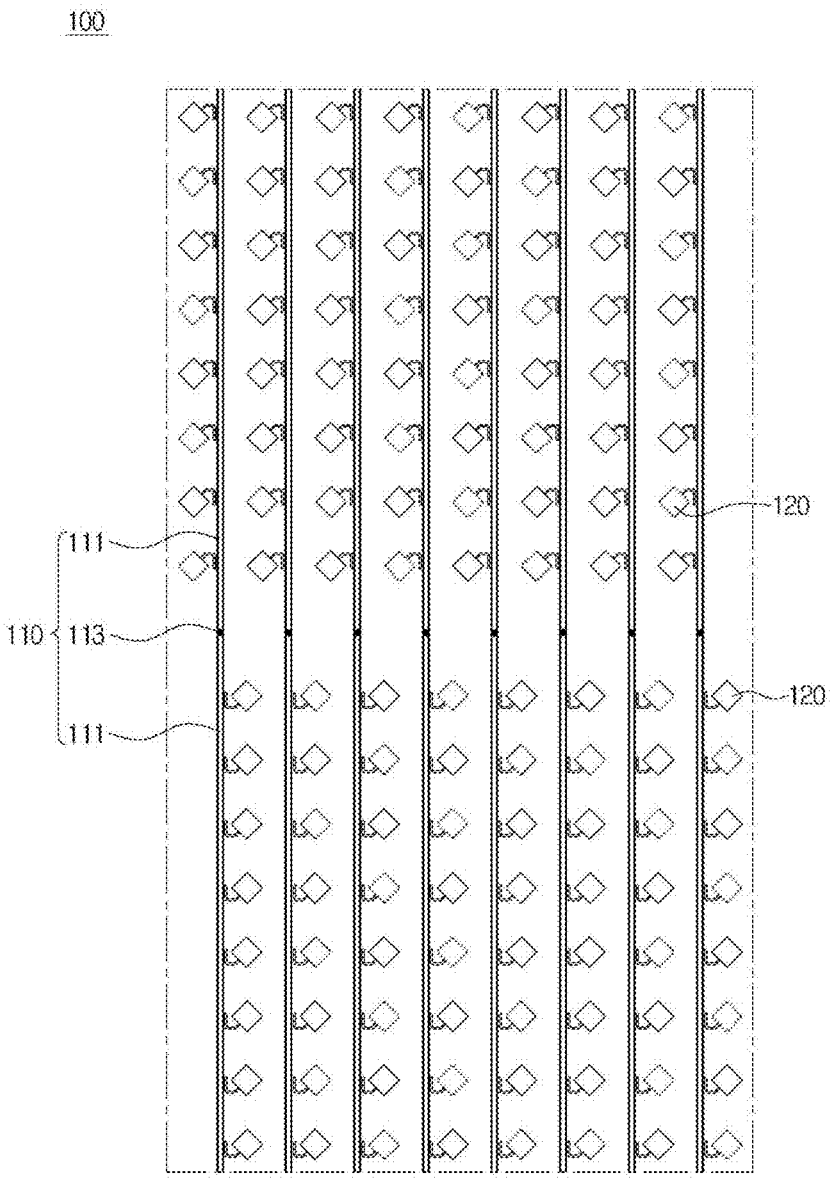

【Figure 4】
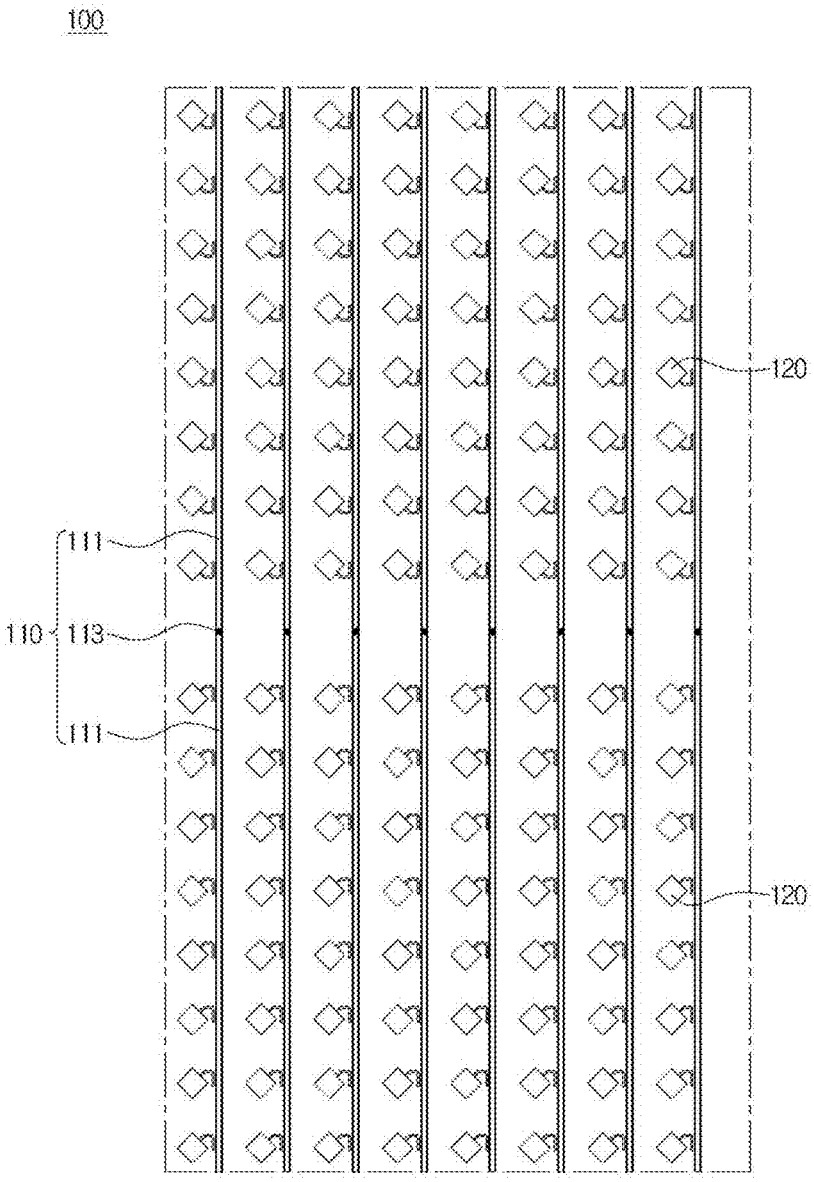

【Figure 5】
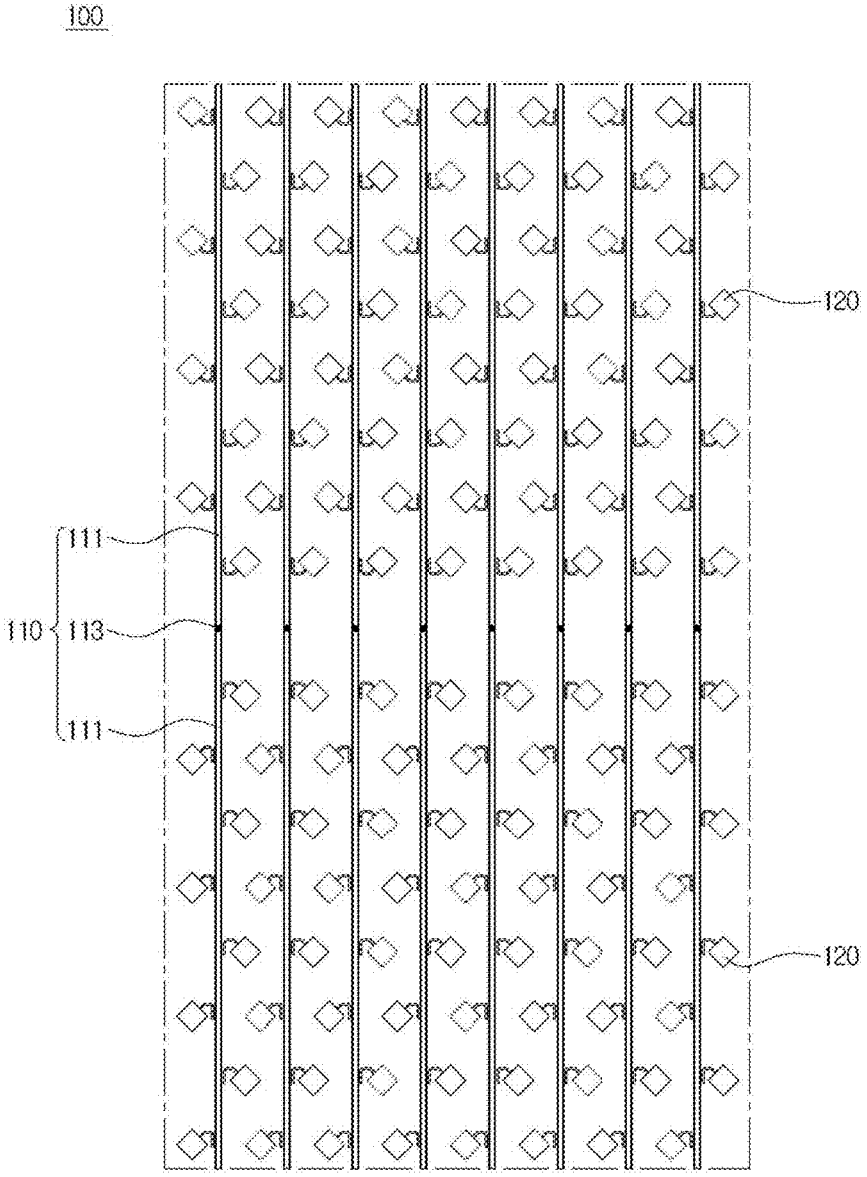

【Figure 6】
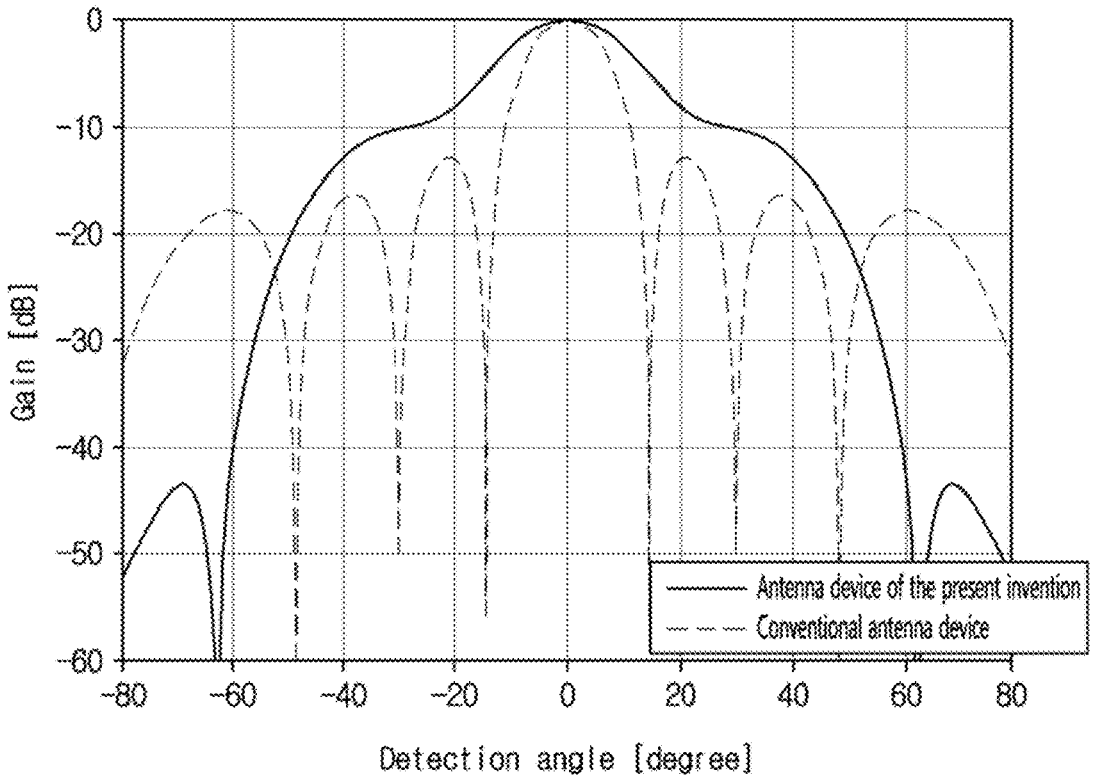

【Figure 7】
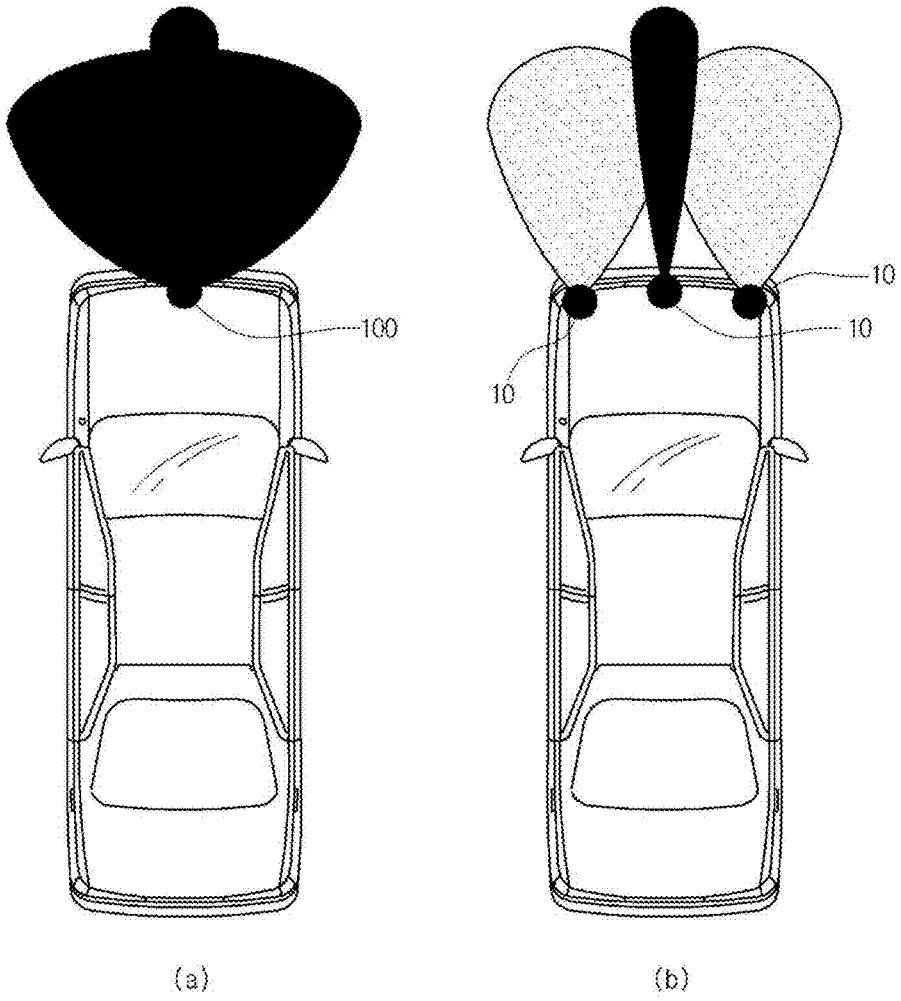

ANTENNA DEVICE FOR RADAR SYSTEM

CROSS-REFERENCE TO RELATED APPLICATION

This application is the U.S. national stage application of International Patent Application No. PCT/KR2014/007798, filed Aug. 21, 2014, which claims priority to Korean Application No. 10-2013-0099301, filed Aug. 21, 2013, the disclosures of each of which are incorporated herein by reference in their entirety.

TECHNICAL FIELD

The disclosure relates to a radar system, and more particularly to an antenna device for a radar system.

BACKGROUND ART

In general, a radar system has been applied to various technical fields. In this case, the radar system is mounted in a vehicle to improve the mobility of the vehicle. The radar system detects information on surrounding environments of the vehicle using an electromagnetic wave. In addition, as relevant information is used in the movement of the vehicle, the efficiency can be improved in the movement of the vehicle. To this end, the radar system includes an antenna device. In other words, the radar system transceives the electromagnetic wave through the antenna device. The antenna device includes a plurality of radars. In this case, the radiators are formed in predetermined size and shape.

However, in the antenna device for the above radar system, the radiators are not uniform in performance thereof. This is because various environmental factors, such as a loss factor, may exist according to the locations of the radiators in the antenna device. In addition, the antenna device for the radar system has a predetermined detection range. Therefore, the radar system, which has one antenna device, may not detect information in a wide range. In addition, when the radar system has a plurality of antenna devices, the size of the radar system and cost may be increased.

DISCLOSURE

Technical Problem

The disclosure provides an antenna device capable of improving the operating efficiency of a radar system. In other words, the disclosure is to uniformly ensure the performance of radiators in an antenna device. In addition, the disclosure is to expand a detection range of a radar system without enlarging the radar system.

Technical Solution

In order to accomplish the above object, an antenna device for a radar system according to the disclosure includes a power supply unit, and a plurality of radiators spaced apart from the power supply unit.

Advantageous Effects

As described above, in the antenna device for the radar system according to the disclosure, as the radiators are formed according to respective weights, the performance of the radiators can be uniformly ensured. In detail, the required resonance frequency and the required radiation coefficient may be ensured according to the radiators, and the impedance matching can be achieved. In addition, the beam width of the antenna device can be more expanded. In addition, various detection distances can be realized in one antenna device. Accordingly, the radar system includes one antenna device, so that the required detection range can be ensured. In other words, even if the radar system is not enlarged, the radar system can have an expanded detection range. Therefore, the performance of the radar system can be improved. Furthermore, the manufacturing cost of the radar system can be saved.

DESCRIPTION OF DRAWINGS

FIG. 1 is a plan view showing an antenna device for a radar system according to the embodiment of the disclosure.

FIG. 2 is an enlarged view showing a part 'A' of FIG. 1.

FIGS. 3, 4, and 5 are plan views showing modifications of the antenna device according to the embodiment of the disclosure.

FIG. 6 is a graph to explain gains according to detection angles of the antenna device according to the embodiment of the disclosure.

FIG. 7 is a view to explain a beam width of the antenna device according to the embodiment of the disclosure.

BEST MODE

Mode for Invention

Hereinafter, exemplary embodiments of the present invention will be described with reference to accompanying drawings. In the following description, if detailed description about well-known functions or configurations may make the subject matter of the disclosure unclear, the detailed description will be omitted.

FIG. 1 is a plan view showing an antenna device for a radar system according to the embodiment of the disclosure. FIG. 2 is an enlarged view showing a part 'A' of FIG. 1. FIGS. 3, 4, and 5 are plan views showing modifications of the antenna device according to the embodiment of the disclosure.

Referring to FIGS. 1 and 2, an antenna device 100 for a radar system according to the present embodiment includes a power supply unit 110 and a plurality of radiators 120. In this case, the case that eight radiators 120 are arranged in a transversal axis will be described below according to the present embodiment, but the disclosure is not limited thereto.

The power supply unit 110 supplies a signal to the radiators 120 in the antenna device 100. In this case, the power supply unit 110 is connected with a control module (not shown). In addition, the power supply unit 110 receives a signal from the control module, and supplies the signal to the radiators 120. In addition, the power supply unit 110 includes a conductive material. In this case, the power supply unit 110 may include at least one of silver (Ag), palladium (Pd), platinum (Pt), copper (Cu), gold (Au), and nickel (Ni).

The power supply unit 110 includes a plurality of feeding lines 111. The feeding lines 111 extend in one direction. In addition, the feeding lines 111 are arranged in parallel to each other in another direction. In this case, the feeding lines 111 are spaced apart from each other by a predetermined distance. In addition, a feeding point 113 is provided on each feeding line 111. In other words, a signal is supplied from the feeding point 113 to the feeding line 111.

In this case, the feeding point 113 may be provided on the center of the feeding line 111. In this case, the signal may be transmitted to both end portions of the feeding line 111 from the feeding point 113. Although not shown, the feeding point 113 may be provided at one end portion of the feeding line 111. In this case, the signal may be transmitted to the opposite end portion of the feeding line 111.

The radiators 120 radiate a signal in the antenna device 100. In this case, the radiators 120 are spaced apart from the power supply unit 110. In this case, the radiators 120 may be distributed along the feeding lines 111. In other words, the radiators 120 are spaced apart from the feeding lines 111 without being in direct contact with the feeding lines 111. In addition, the radiators 120 are coupled to the power supply unit 110. In other words, the radiators 120 are electromagnetically coupled to the feeding lines 111. Accordingly, the radiators 120 become in an excited state, and a signal is supplied from the power supply unit 110 to the radiators 120. In addition, the radiators 120 are formed of a conductive material. In this case, the radiators 120 may include at least one Ag, Pd, Pt, Cu, Au, and Ni.

In this case, when the feeding point 113 is provided at the center of the feeding line 111, the radiators 120 may be variously arranged at both side portions of the feeding point 113. For example, the radiators 120 may be arranged at one side portion of the feeding line 111 when arranged at one side portion of the feeding point 113, and provided at the other side portion of the feeding line 111 when arranged at the other side portion of the feeding point 113. In addition, as shown in FIG. 3, the radiators 120 may be provided at the other side portions of the feeding line 111 when arranged at one side portion of the feeding point 113, and provided at one side portion of the feeding line 111 when arranged at the other side portion of the feeding point 113. Accordingly, signals may be induced from the feeding line 111 to the radiators 120 in the same direction.

Meanwhile, as shown in FIG. 4, the radiators 120 may be arranged at the other side portion of the feeding line 111 when arranged at one side portion and the other side portion of the feeding point 113. In addition, although not shown, the radiators 120 may be arranged at one side portion of the feeding line 111 when arranged at one side portion and the other side portion of the feeding point 113. In addition, as shown in FIG. 5, the radiators 120 may be alternately arranged at both side portions of the feeding line 111 when arranged at both side portions of the feeding point 113. Accordingly, signals may be induced from the feeding line 111 to the radiators 120 in directions different from each other.

In addition, weights are individually preset to the radiators 120. In other words, each radiator 120 has a unique weight. In this case, the weights are set corresponding to the radiators 120 to acquire resonance frequencies, radiation coefficients, beam widths, and detection distances of the respective radiators 120, and for impedance matching. In this case, corresponding to the radiators 120, the weights can be calculated through a Taylor function or a Chebyshev function. In addition, the weights may be set variously depending on the locations of the radiators 120.

Two axes, which cross each other at the center of the power supply unit 110, are defined as follows. One axis extends from the center of the power supply unit 110 in parallel to the feeding line 111. The other axis extends from the center of the feeding line 111 perpendicularly to one axis. In this case, when the feeding point 113 is provided at the center of the feeding line 111, one axis extends from the feeding point 113 in parallel to the feeding lines 111, and the other axis extends perpendicularly to one axis. Accordingly, the weights are set for the radiators 120 symmetrically to each other about one axis and the other axis.

In addition, each radiator 120 is formed using a parameter determined depending on the relevant weight. In this case, the parameter of the radiator 120 may determine the arrangement relationship between the radiator 120 and the power supply unit 110, the size of the radiator 120, and the shape of the radiator 120. The radiator 120 includes a coupling unit 121 and a radiation unit 123. The parameter of the radiator 120 includes an interval d between the coupling unit 121 and the power supply unit 110, the length $l_1$ of the coupling unit 121, the weight $w_1$ of the coupling unit 121, the length $l_2$ of the radiation unit 123, and the width $w_2$ of the radiation unit 123.

The coupling unit 121 is provided in the radiator 120 to be adjacent to the power supply unit 110. In addition, at least a portion of the coupling unit 121 extends in an extension direction of the power supply unit 110. In other words, at least the portion of the coupling unit 121 extends in parallel to the power supply unit 110. In this case, one end portion of the coupling unit 121 is open. In addition, the coupling unit 121 is actually coupled to the power supply unit 110. In this case, the interval d between the coupling unit 121 and the power supply unit 110, the length $l_1$ of the coupling unit 121, and the width $w_1$ of the coupling unit 121 are defined. The interval d between the coupling unit 121 and the power supply unit 110 corresponds to a perpendicular direction to the extension direction of the power supply unit 110. The length $l_1$ of the coupling unit 121 corresponds to the extension direction of the coupling unit 121. The width $w_1$ of the coupling unit 121 corresponds to the perpendicular direction to the extension direction of the coupling unit 121.

The radiation unit 123 is connected with the coupling unit 121. The radiation unit 123 is connected with the opposite end of the coupling unit 121. In addition, the radiation unit 123 extends from the coupling unit 121 in the extension direction of the coupling unit 121. Accordingly, a signal may be transmitted from the coupling unit 121 to the radiation unit 123. In this case, the length $l_2$ of the radiation unit 123 and the width $w_2$ of the radiation unit 123 are defined. The length $l_2$ of the radiation unit 123 corresponds to the extension direction of the radiation unit 123. The width $w_2$ of the radiation unit 123 corresponds to the perpendicular direction to the extension direction of the radiation unit 123.

FIGS. 6 and 7 are views to explain operating characteristics of the antenna device according to the embodiment of the disclosure. In this case, FIG. 6 is a graph to explain a gain as a function of a detection angle of the antenna device according to the embodiment of the disclosure. In this case, the gain indicates the degree that a signal is concentrated on and radiated from the antenna device in a required direction. In the following description, a main lobe represents a direction that the signal is concentrated on and radiated from the antenna device, and a minor lobe represents other directions that the signal is slightly radiated from the antenna device, other than that of the main lobe. In addition, FIG. 7 is a view to explain a beam width of the antenna device according to the embodiment of the disclosure.

Referring to FIG. 6, a conventional antenna device 10 has a plurality of minor lobes in addition to a main lobe. Accordingly, a null section is formed in the range of −20 degree to 20 degree. In addition, the conventional antenna device 100 has a predetermined detection distance. Accordingly, the conventional radar system must include a plurality of antenna devices 10 as shown in FIG. 7(*b*) in order to ensure a desired detection range and a desired detection distance.

In contrast to the conventional radar system, according to the antenna device 100 according to the embodiment of the disclosure, the null section is filled in the range of −60 degree to 60 degree, so that the minor lobes are suppressed. Accordingly, the performance of the antenna device 100 according to the embodiment of the disclosure is improved, so that the antenna device 100 has a more enlarged detection angle, that is, a more enlarged main lobe. In other words, the antenna device 100 according to the embodiment of the disclosure has a more enlarged beam width. As well, the antenna device 100 according to the embodiment of the disclosure has various detection distances. Therefore, the radar system according to the embodiment of the disclosure has one antenna device 100 as shown in FIG. 7(*a*), so that a required detection range can be ensured.

According to the disclosure, as the radiators 120 are formed according to respective weights, the performance of the radiators 120 may be uniformly ensured. In detail, the required resonance frequency and the required radiation coefficient may be ensured according to the radiators 120, and the impedance matching may be performed without an additional component in the radiator 120. In addition, the beam width of the antenna device may be more expanded. In addition, various detection distances may be realized in one antenna device 100. Accordingly, the radar system includes one antenna device 100, so that the required detection range can be ensured. In other words, even if the radar system is not enlarged, the radar system may have an expanded detection range. Therefore, the performance of the radar system may be improved. Furthermore, the manufacturing cost of the radar system may be saved.

Although an exemplary embodiment of the disclosure has been described for illustrative purposes, those skilled in the art will appreciate that various modifications, additions and substitutions are possible, without departing from the scope and spirit of the invention as disclosed in the accompanying claims.

The invention claimed is:

1. An antenna device for a radar system, the antenna device comprising:

a power supply unit including a feeding point that supplies a signal, and a feeding line that extends from the feeding point; and a plurality of radiators spaced apart from the power supply unit, wherein each radiator is formed based on a parameter determined depending on a preset weight for the radiator, and wherein each radiator is electromagnetically coupled to the power supply unit without physical connection to the power supply unit;

wherein the feeding point is provided at a center of the feeding line, wherein the plurality of radiators comprises:

a first radiator group arranged at an upper side portion of the feeding point, and a second radiator group arranged at a lower side portion of the feeding point;

wherein the first radiator group comprises:

a first radiator part arranged at one side portion of the feeding line, and a second radiator part arranged at other side portion of the feeding line and alternately arranged with the first radiator part;

wherein the second radiator group comprises:

a third radiator part arranged at the one side portion of the feeding line, and a fourth radiator part arranged at the other side portion of the feeding line and alternately arranged with the third radiator part;

wherein the first radiator part and the second radiator part are arranged upward of the feeding line, wherein the third radiator part and the fourth radiator part are arranged downward of the feeding line, wherein each of the first and second radiator parts comprises:

a first coupling unit adjacent to the power supply unit and coupled to the power supply unit, and a first radiation unit extended from the first coupling unit in an extension direction of the first coupling unit;

wherein each of the third and fourth radiator parts comprises:

a second coupling unit adjacent to the power supply unit and coupled to the power supply unit, and a second radiation unit extended from the second coupling unit in an extension direction of the second coupling unit;

wherein the first coupling unit comprises:

a first portion extended upward from the feeding line in parallel to the power supply unit in an extension direction of the power supply unit, and a second portion bent downward from an end of the first portion;

wherein the second coupling unit comprises:

a third portion extended downward from the feeding line in parallel to the power supply unit in the extension direction of the power supply unit, and a fourth portion bent upward from an end of the third portion;

wherein the first and second radiator parts are symmetric to the third and fourth radiator parts, respectively, with respect to the feeding point, and wherein the second portion is symmetric to the fourth portion with respect to the feeding point.

2. The antenna device of claim 1, wherein the parameter includes at least one of an interval between the first or second coupling unit and the power supply unit, a length of the first or second coupling unit, a width of the coupling unit, a length of the radiation unit, and a width of the radiation unit.

3. The antenna device of claim 2, wherein a direction of the length of the first or second coupling unit corresponds to an extension direction of the first or third portion, and a direction of the width of the first or second coupling unit corresponds to a direction perpendicular to the extension direction of the first or third portion.

4. The antenna device of claim 2, wherein a direction of the length of the first or second radiation unit corresponds to an extension direction of the first or second radiation unit, and a direction of the width of the first or second radiation unit corresponds to a perpendicular to the extension direction of the first or second radiation unit.

5. The antenna device of claim 1, wherein a value of the weight is determined based on locations of the radiators, wherein the weight is set to ensure a resonance frequency, a radiation coefficient, a beam width, and a detection distance of each radiator to satisfy requirements of impedance matching, and wherein the weight of a first radiator of the plurality of radiators is set to balance with the weight of a second radiator of the plurality of radiators symmetrically disposed with respect to one axis extending from a center of the power supply unit in parallel to the feeding line, and balance with the weight of a third radiator of the plurality of radiators symmetrically disposed with respect to an opposition axis extending from the center of the power supply unit to be perpendicular to the one axis.

* * * * *